United States Patent [19]

Moraine

[11] Patent Number: 4,722,436

[45] Date of Patent: Feb. 2, 1988

[54] PROTECTIVE CASING FOR AN ARTILLERY SHELL WITH A COMBUSTIBLE SLEEVE

[75] Inventor: Gérard Moraine, Chaville, France

[73] Assignee: Société Bourguignonne D'Applications Plastique (Société Anonyme), Paris, France

[21] Appl. No.: 4,859

[22] Filed: Jan. 12, 1987

Related U.S. Application Data

[63] Continuation of Ser. No. 732,212, May 9, 1985, abandoned.

[30] Foreign Application Priority Data

May 14, 1984 [FR] France ..... 84 07540

[51] Int. Cl.[4] ..... F42B 37/00

[52] U.S. Cl. ..... 206/3; 206/527; 220/320; 220/319

[58] Field of Search ..... 206/3, 527, 583; 215/273, 274, 275; 220/315, 320, 319, 324, 446; 89/36.01, 36.05, 34

[56] References Cited

U.S. PATENT DOCUMENTS 4,598,623 7/1986 Hersemeyer et al. ..... 206/3

*Primary Examiner*—Stephen Marcus
*Assistant Examiner*—David T. Fidei
*Attorney, Agent, or Firm*—Spencer & Frank

[57] ABSTRACT

The protective casing particularly suitable for packing artillery shells which have a combustible sleeve, the casing being composed of two half-sections 3, 4 which are made of a thermoplastic and shaped so as to remain attached to support points 10, 11, 12, 13 of a projectile part 2 when assembled around this part, a rigid protection tube 5 fitted over the assembled half-sections 3, 4 and over the combustible sleeve 1, and a locking device 6 ensuring a mechanical connection between the assembled half-sections 3, 4 and the rigid protection tube 5 so as to prevent any relative axial displacement between these elements 3, 4 and 5.

9 Claims, 2 Drawing Figures

A - A'

PROTECTIVE CASING FOR AN ARTILLERY SHELL WITH A COMBUSTIBLE SLEEVE

This application is a continuation, of application Ser. No. 732,212, filed May 9, 1985, now abandoned.

BACKGROUND OF THE INVENTION

The present invention relates to a protective casing especially designed for packing an artillery shell which has a combustible sleeve and which is intended to be placed inside a container.

Artillery shells with combustible sleeves require special precautions as regards their packing for transport and storage. In fact, it is important to protect effectively not only the sleeve of such shells, which is a more delicate part than the sleeve of a conventional shell, but also to prevent the projectile part penetrating into the sleeve as a result of inertia, for example, in the case of an axial impact on the front or on the rear of the shell.

In Belgian Patent No. 887,840, a special packing suitable for packing combustible sleeves has already been described, this packing involving the use of a tubular sheet of kraft paper which, if necessary, is reinforced and arranged around the sleeve. This type of packing effectively protects the packed sleeve against lateral impact, but is not suitable for packing shells which have not only a combustible sleeve but also a projectile part of relatively large mass, which is connected to the sleeve.

French Patent Application No. 2,477,697 also describes a method of packing shells which have sleeves, involving the use of two moulded half-sections, for example, which are made of polyurethane and the inner surface of which matches the outer surfaces of the front of the sleeve and the rear of the rounded part of the shell which is smaller in diameter, as well as the use of a tubular section which surrounds only the half-sections and holds them together. Such a method cannot be used for safely packing a shell with a combustible sleeve, because it would not protect such a shell against the dangerous effects of an axial impact at its ends.

SUMMARY OF THE INVENTION

The object of the present invention is to provide a protective casing for an artillery shell with a combustible sleeve, which protects the latter against any type of impact.

It therefore relates to a protective casing for an artillery shell with a combustible sleeve, comprising two half-sections which are made of an expanded thermoplastic and are assembled around the projectile part of the shell, the assembled half-sections having a maximum external diameter substantially equal to the external diameter of the combustible sleeve and being shaped so as to remain attached to support points present or to be provided on the projectile part, and in which the half-sections are held together by a rigid protection tube fitted over the latter and over the entire combustible sleeve, characterised in that it comprises a means for mechanically locking the assembled half-sections with the protection tube, thereby preventing any relative axial displacement between these elements.

The casing according to the invention ensures effective protection of the combustible sleeve and of the projectile part against lateral impact by means of the protection tube, or of the protection tube/half-section assembly against axial impact by means of the connection effected between the assembled half-sections and the rigid protection tube.

The locking means may be of any kind, provided that it effectively prevents any relative axial displacement between the assembled half-sections and the protection tube as a result of external stresses. However, according to a preferred embodiment, the locking means consists of at least one elastic ring or collar surrounding at least partially the protection tube and provided, on its inner side, with projections which axially lock the assembled half-sections by means of openings provided in the wall of the protective tube. In order to complete this locking arrangement, it is useful to provide appropriate recesses in the outer surface of the assembled half-sections, which are intended to receive the ends of the projections provided on the inner aide of the elastic ring. The elastic ring which ensures mechanical locking of the protection tube with the assembled half-sections may be made of any suitable material and in particular of plastic or metal.

The half-sections are generally symmetrical and have an innner profile which matches the outer profile of the projectile part. Moreover, the half-sections must be designed so that their inner profile has points for attachment to support points present on the projectile part so that, after these half-sections have been assembled, they are unable to move axially relative to the projectile part, the latter being locked in position inside the half-sections. In the case where the projectile part does not have sufficient support points to achieve such a locking arrangement, the projectile part can be provided with metal inserts or other elements fixed to the projectile part so as to obtain suitable support points.

Advantageously, the two half-sections may have fastening means such as complementary recesses and projections on their surfaces which may contact during assembly so as to facilitate the correct positioning of these half-sections around the projectile part and complete their assembly.

The half-sections are generally made by means of moulding and in particular by means of injection-moulding, using an expandable thermoplastic such as an olefin resin, a styrene resin or a polyurethane resin. Generally, an injectable polyurethane resin is preferred. The expandable resin chosen must have an adequate mechanical strength, rigidity and abrasion resistance so that the moulded halfsections are able to perform their function of locking the projectile part of the shell in position.

As mentioned above, it may be advantageous to provide on the outer surface of the half-sections means such as recesses inside which projections provided on the inner side of the elastic collar can be fixed, so as to obtain perfect mechanical locking of the rigid protection tube with the assembled half-sections.

Finally, the assembled half-sections must have located at intervals over the entire length of their outer surface, points for resting against the protection tube.

The rigid protection tube, the internal diameter of which is substantially equal to the external diameter of the combustible sleeve, must have an impact strength and flexural strength sufficient to ensure protection of the shell. This tube extends over the entire length of the shell onto which it is fitted after the half-sections have been positioned around the projectile part of the shell.

The rigid protection tube may advantageously be made from material such as paper, cardboard, plastic and metal. It may be produced by means of bending, rolling, extrusion, etc.

It is advantageous to design and arrange the protection tube so that one of its ends rests on the edge of the base of the combustible sleeve.

Finally, it is expedient to provide suitable openings in the wall of the protection tube so as to allow it to be locked with the assembled half-sections by arranging the elastic ring in position.

The shell with a combustible sleeve, provided with the protective casing according to the invention, may advantageously be placed in a container providing additional packing for transport and storage purposes. Such a container is, for example, described in French Patent Application No. 2,317,625.

The protective casing may, however, be used only for storing shells with a combustible sleeve.

BRIEF DESCRIPTION OF THE DRAWINGS

The protective casing according to the invention is, moreover, described in greater detail in the following description of a particular embodiment. In this description, reference will be made to the figures in the attached drawings, in which.

DESCRIPTION OF THE PREFERRED EMBODIMENTS

Figure 1:
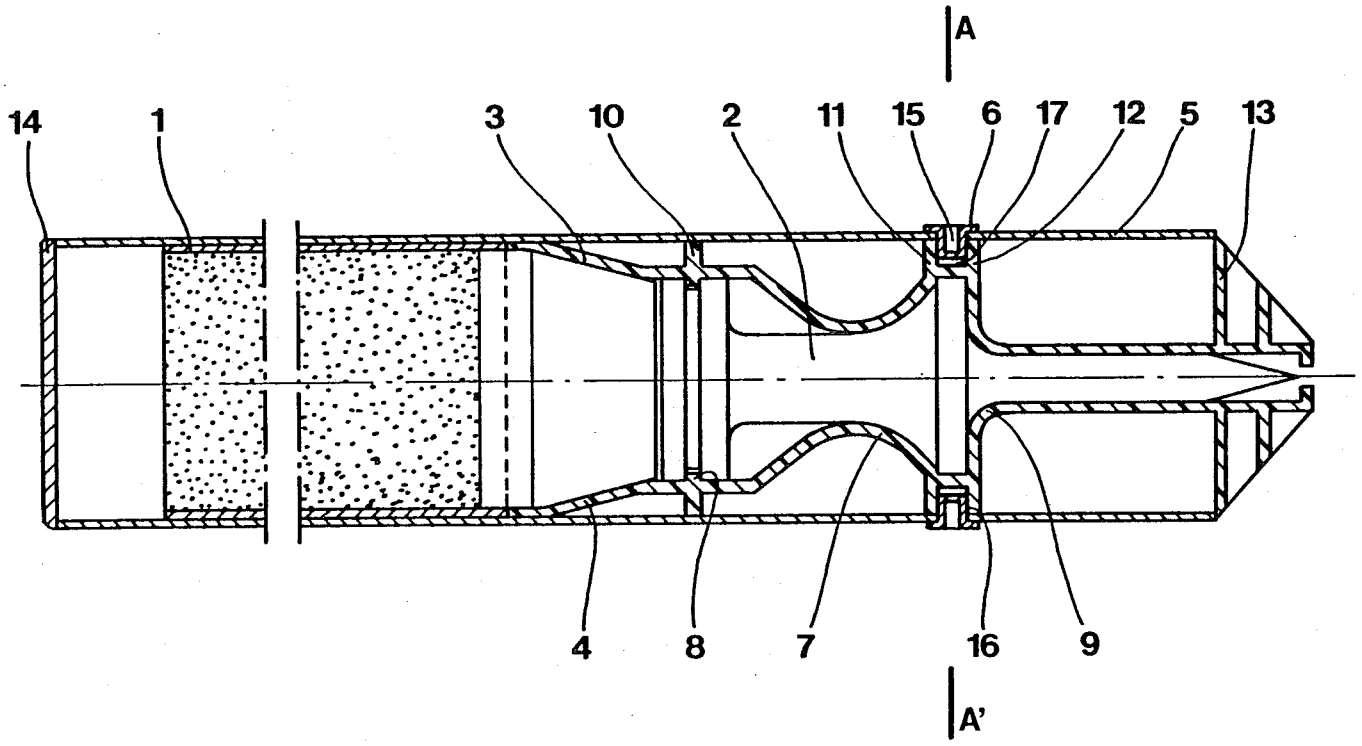
FIG. 1 is a view, in elevation and in partial cross-section, of a protective casing according to the invention.
Figure 2:
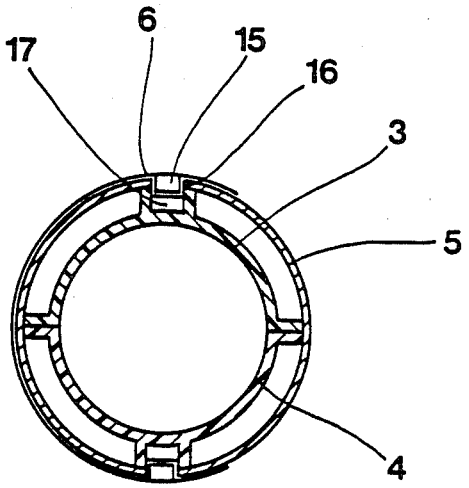
FIG. 2 is a sectional view along the line AA' of FIG. 1.

As can be seen in the figures, the protective casing for a shell comprising a combustible sleeve 1 and a projectile part 2 consists of two assembled half-sections 3, 4 made of an expanded thermoplastic, a rigid protection tube 5 and an elastic collar 6 ensuring mechanical locking of the assembled half-sections 3, 4 with the rigid protection tube 5.

The assembled half-sections 3, 4 have an inner profile which matches the outer profile of the projectile part 2 and which comprises points 7, 8, 9 for attachment to support points on the projectile part, which ensure axial locking of the assembled half-sections 3, 4 with the projectile part 2. The assembled half-sections 3, 4 have a maximum external diameter equal to the external diameter of the sleeve and are provided on their outer surface with points 10, 11, 12, 13 for resting against the rigid protection tube 5 fitted over the assembled sections.

The rigid protection tube 5, which has an internal diameter substantially equal to the external diameter of the combustible sleeve 1, is made of cardboard, for example, by means of a rolling-up operation.

The rigid protection tube 5 extends over practically the entire length of the shell. This protection tube 5, which is fitted over the combustible sleeve 1 and the assembled half-sections 3, 4, rests with its end on the base 14 of the combustible sleeve 1. Moreover, the inner wall of the protection tube 5 rests on the partitions of the support points 10, 11, 12, 13, which are provided on the outer surface of the assembled half-sections 3, 4.

Mechanical locking, which prevents any relative axial displacement between the assembled half-sections 3, 4 and the rigid protection tube 5, is ensured by means of an elastic collar 6 partially surrounding the rigid protection tube 5 and provided on its inner side with projections 15 which axially lock the assembled half-sections 3, 4 in position by means of openings 16 provided in the wall of the rigid protection tube 5. Moreover, as can be seen in FIG. 1, the partitions of the support points 11, 12 provided on the outer surface of the assembled half-sections 3, 4 define a recess 17 which is able to receive the projections 15 provided on the elastic collar 6, so as to ensure perfect axial locking of the half-sections.

In order to pack the shell in the protective casing described above, it is sufficient to assemble the two half-sections 3, 4 around the projectile part 2 of the shell and then fit the rigid protection tube 5 over the assembled half-sections 3, 4 and over the combustible sleeve 1 so that the end of the protection tube comes up against the edge of the base 14 of the sleeve 1, and finally to position the elastic collar 6. As a result, the elastic collar 6 ensures locking of the protection tube 5 with the assembled half-sections 3, 4, thereby preventing any relative axial displacement between these elements 3, 4 and 5 and consequently any relative axial displacement between the combustible sleeve 1 and the projectile part 2 of the shell, resulting from any impact against the ends of the protective casing.

Although the protective casing described above is particularly suitable for packing artillery shells with combustible sleeves, it is obvious that this protective casing can also be used for packing conventional artillery shells with non-combustible sleeves.

I claim:

1. Protective casing for an artillery shell with a combustible sleeve (1) and a projectile part (2), comprising two half-sections (3, 4) each having an arcuate extent, about the axis of the projectile part, corresponding to only a respective portion of the entire circumference of the projectile part of the shell and both half-sections together surrounding the entire circumference of the projectile part, said half-sections being made of an expanded thermoplastic and being assembled together around the projectile part (2) of the shell, the assembled half-sections (3, 4) having a maximum external diameter substantially equal to, and not greater than, the external diameter of the combustible sleeve and being shaped so as to remain fixed to support points (10, 11, 12, 13) on the projectile part, and in which the half-sections (3, 4) are held together by a rigid protection tube (5) having a longitudinal dimension and having a constant cross section over the entirety of the longitudinal dimension, said protection tube being fitted over the two half-sections and contacting the combustible sleeve (1) over the entire length of the sleeve, characterised in that said protective casing further comprises a means (6) for mechanically locking the assembled half-sections (3, 4) with the protection tube (5), thereby preventing any relative axial displacement between these elements (3, 4) and (5), and wherein said half-sections have a length dimension such that they abut the combustible sleeve when said half-sections are assembled around the projectile part of the shell.

2. Protective casing according to claim 1, characterised in that the locking means (6) consists of at least one elastic ring (6) surrounding at least partially the protection tube (5) and provided, on its inner side, with projections (15) which axially lock the assembled halfsections (3, 4) in position by means of openings (16) provided in the wall of the protection tube (5).

3. Protective casing according to claim 2, characterised in that the projections (15) provided on the inner side of the elastic ring (6) are provided with ends which are fixed in suitable recesses (17) in the outer surface of the assembled half-sections (3, 4).

4. Protective casing according to claim 3, characterised in that the elastic ring (6) is made of a material chosen from the group consisting of metals and plastics.

5. Protective casing according to claim 1 characterised in that the half-sections (3, 4) are made by means of moulding, using an expandable material chosen from the group consisting of olefin resins, styrene resins and polyurethane resins.

6. Protective casing according to claim 1 characterised in that the rigid protection tube (5) is made of a material chosen from the group consisting of paper, cardboard, plastics, and metals.

7. Protective casing according to claim 1 characterised in that one end of the rigid protection tube (5) rests on the edge of the base (14) of the combustible sleeve (1).

8. Protective casing according to claim 1, characterised in that the two half sections each have an inner profile which substantially matches the support points of the projectile part.

9. Protective casing according to claim 1, characterised in that the two-half sections each have a semicircular cross-section.

* * * * *